United States Patent [19]

Schlaudecker

[11] Patent Number: 4,886,175

[45] Date of Patent: Dec. 12, 1989

[54] BOTTLE AND CAP CLOSURE SYSTEM

[75] Inventor: Thomas E. Schlaudecker, Hamilton Square, N.J.

[73] Assignee: Merck & Co., Inc., Rahway, N.J.

[21] Appl. No.: 335,358

[22] Filed: Apr. 10, 1989

[51] Int. Cl.[4] ..... B65D 41/34

[52] U.S. Cl. ..... 215/32; 215/226; 215/251; 215/256; 220/270

[58] Field of Search ..... 215/256, 251, 226, 32; 220/257, 258, 256, 270

[56] References Cited

U.S. PATENT DOCUMENTS

| | | | |
|---|---|---|---|
| 3,955,716 | 5/1976 | Goncalves | 215/256 X |
| 4,066,181 | 1/1978 | Robinson et al. | 215/256 |
| 4,134,511 | 1/1979 | Deussen | 215/32 |
| 4,565,294 | 1/1986 | Smith | 220/257 X |

FOREIGN PATENT DOCUMENTS

| | | | |
|---|---|---|---|
| 2364627 | 6/1975 | Fed. Rep. of Germany | 215/32 |

*Primary Examiner*—Donald F. Norton

*Attorney, Agent, or Firm*—Salvatore C. Mitri; Joseph F. DiPrima

[57] ABSTRACT

There is disclosed a novel bottle and cap closure system for dropper bottles and the like which comprises a set of lugs or cams and a snap bead provided in the cap and a set of lugs or cams provided on the neck portion of the bottle. After the bottle is filled, the cap is secured to the bottle by having the snap bead on the cap engage the lugs or cams on the bottle. The snap bead in the cap is carried on the circumferential lower edge of a tear-away band. After the tear-away band is removed to use the contents of the bottle, the cap is re-secured to the bottle by engaging the lugs or cams in the cap to the lugs or cams on the bottle.

8 Claims, 2 Drawing Sheets

BOTTLE AND CAP CLOSURE SYSTEM

BACKGROUND OF THE INVENTION

This invention is directed toward a novel bottle and cap closure system which is particularly well suited for use with dropper type bottles.

Many dropper type bottles presently in commercial use have an elongated tip portion that terminates with a break off tab seal. Thus, after the bottle has been filled and the break off tab seal has been applied, the contents of the bottle can not spill out nor can the contents of the bottle be contaminated by the atmosphere. Non-contamination of the bottle contents is an important consideration, particularly when the contents of the bottle is a medication which must be kept sterile until use. The break off tab seal is protected by securing a cap to the bottle to complete closure of the bottle. Typically, the cap is secured to the bottle by means of threads provided in the cap and on the neck of the bottle so that the cap is screwed onto the bottle.

These dropper-type bottles are generally filled, the break off tab seal applied and the cap screwed onto the bottle in assembly-line fashion. Under these condiditions, a cap applying apparatus is used to screw the cap onto the bottle. If the torque of the cap applying apparatus is not closely controlled and frequently monitored, the cap can be secured too loosely or too tightly. If secured too loosely, the cap can fall off during subsequent handling and shipping exposing the break off tab seal to premature removal thereby subjecting the contents of the bottle to spillage and contamination. If secured too tightly, the cap can bear upon the break off tab seal either causing its premature removal or exerting sufficient pressure to cause the relatively delicate elongated tip portion to crack. In either instance, the contents of the bottle is subject to spillage and contamination.

GENERAL DESCRIPTION OF THE INVENTION

It has now been found that the disadvantages and short comings of these screw on cap systems are overcome by the bottle and cap closure system of this invention. In general, the bottle and cap closure system of the invention comprises a set of spaced lugs or cams formed on the inner circumferential surface of the cap and a set of lugs or cams formed on the outer circumferential surface of the neck of the bottle. The lower portion of the cap beneath its lugs or cams is in the form of a tear away band whose lower circumferential edge terminates in an inwardly protruding snap bead. Sufficient distance is provided between the inner surface of the top of the cap and the snap bead so that when the cap is secured to the bottle, the top of the cap does not contact the break off tab seal.

During assembly, a bottle is positioned beneath a cap applying apparatus that lowers the cap over the break off tab seal and the elongated tip portion until the snap bead engages the lugs or cams on the neck of the bottle. The lower end of the neck of the bottle is provided with a circumferential shoulder to arrest the downward movement of the cap thereby preventing the top of the cap from contacting the break off tab seal. In this way, the break off tab seal and the elongated tip of the bottle are completely protected from accidental breakage and the contents of the bottle remain securely sealed, free from spillage or contamination, until ready for use.

When the contents of the bottle are ready to be used, the tear away band is removed, the bottle is uncapped, the break off tab seal is broken off and the contents of the bottle dispensed through the elongated tip portion. The cap is then resecured to the bottle by manually placing the cap over the elongated tip portion and manually exerting slight downward turning pressure on the cap until the lugs or cams in the cap securely engage the lugs or cams on the neck of the bottle.

DETAILED DESCRIPTION OF THE INVENTION

The novel bottle and cap closure system of the invention will become more clear from the ensuing description when considered together with the accompanying drawing wherein like reference numerals denote like parts and wherein.

Figure 2:
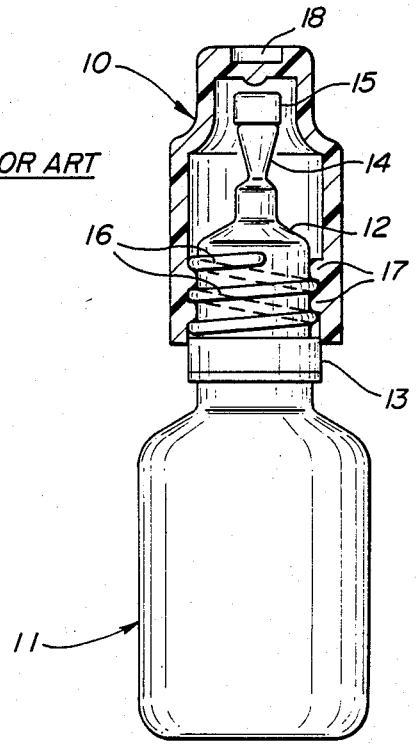
FIG-2 PRIOR ART
FIG. 2 is a front elevation view of a typical prior art dropper bottle and cap with the cap shown in cross section for clarity.

As shown in FIG. 2, a typical, commercial dropper bottle and cap comprises a cap, generally identified at 10, and a bottle, generally shown at 11, which contains the material or liquid to be dispensed from the bottle.

The upper configuration of bottle 11 generally has a tapered neck portion 12 extending upwardly from a shoulder 13 at the upper end of the body of the bottle. Extending upwardly from tapered neck portion 12 is an elongation tip portion 14 which terminates at its upper end with a break off tab seal 15. Break off tab seal 15 is conventionally manufactured to have a geometric cross section in the form of a square, rectangular, hexagonal, and the like.

The lower portion of tapered neck portion 12 carries circumferential, helically wound continuous threads 16 which mate with circumferential, helically wound threads 17 provided on the inner surface of cap 10.

A wrench well 18 is recessed in the top of cap 10 and is formed to have the same geometric configuration as break off tab seal 15.

During manufacture and assembly, bottle 11 is filled with the material or liquid to be dispensed therefrom and break off tab seal 15 is bonded to the top of the elongated tip 14 to hermistatically seal the bottle and protect its contents from spilling out. Tab seal 15 also protects the bottle contents from becoming contaminated, particularly when the bottle contains medicine which must be kept in a sterile state until use. Cap 10 is then secured to bottle 11 by screwing threads 17 onto threads 16 by means of an automatic cap applying apparatus.

As mentioned earlier, the torque of the cap applying apparatus must be closely controlled. If too much torque is imparted to the cap applying apparatus, it will tend to screw cap 10 too far down onto tapered neck portion 12 frequently causing the inner surface of cap 10 to bear upon break off seal tab 15. When this occurs, seal tab 15 can either be completely or partially broken off of tip 14 or tip portion 14 can become cracked thereby exposing the contents of bottle 11 to air contamination thus compromising the sterility of the bottle contents and/or permitting the bottle contents to leak out during subsequent handling.

If too little torque is imparted to the cap applying apparatus, the cap 10 will have tendency to become unscrewed during subsequent handling thereby exposing tab seal 15 to the possibility of being prematurely broken off.

When these prior art bottles are properly assembled, the bottle contents can be removed by manually unscrewing cap 10 and inverting it to mate wrench well 18 over tab seal 15 and then snapping tab seal 15 off by rotating cap 10 toward the body of bottle 11. The contents of bottle 11 can then be dispensed by inverting bottle 11 and permitting its contents to flow through the elongated tip portion 14.

Figure 1:
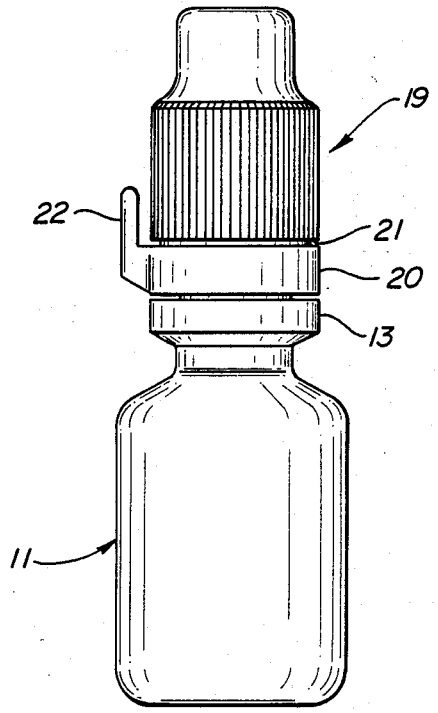
FIG. 1 is a front elevation of the bottle and cap closure system of the invention shown with a dropper bottle.
Figure 3:
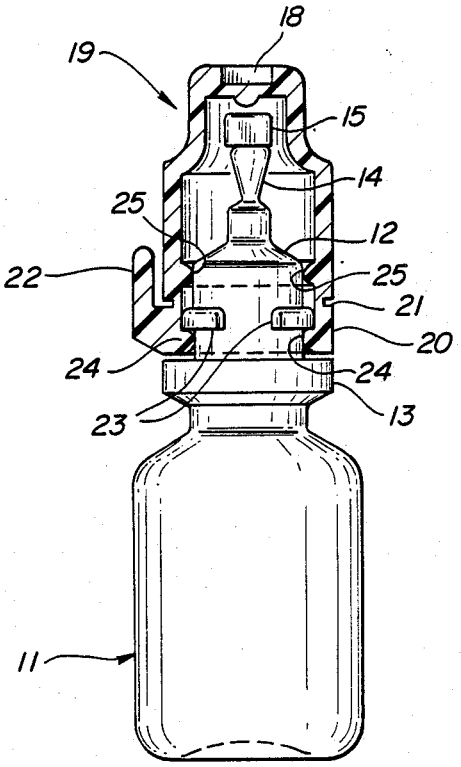
FIG. 3 is a front elevation of the bottle and the cap closure system of the invention with the cap shown in cross section for clarity; and, FIG. 4 is a view similar to that of FIG. 3 illustrating another embodiment of the bottle and cap closure system of the invention.

As shown in FIGS. 1 and 3, the bottle and cap closure system of the invention comprises a cap, generally indicated at 19, having a circumferential tear away band 20 at its open lower end, a circumferential score 21 where band 20 meets the main part of cap 19, and an outwardly protruding pull tab 22 formed integrally with tear away band 20 to facilitate removal of the band from the bottom portion of the cap 19. Cap 19 with band 20, score 21 and pull tab 22 are molded as a unitary article.

A plurality of circumferentially spaced, outwardly protruding lugs or cams 23 are provided on the surface of tapered neck 12 spaced upwardly from shoulder 13 a sufficient distance to frictionally engage and secure inwardly protruding, circumferential snap bead 24 formed at the open, lower edge of cap 19. In the cap 19, a plurality of circumferentially spaced, inwardly protruding lugs or cams 25 are provided upwardly from snap bead 24 and above score 21; i.e., intermediate the upper end of the tear away band 20 and the top of the cap.

Inwardly protruding lugs or cams 25 are positioned above score 21 a sufficient distance such that when tear away band 20 is removed, lugs or cams 25 can frictionally engage and be secured by and beneath outwardly protruding lugs or cams 23 on the tapered neck 12 of bottle 11.

Figure 4:
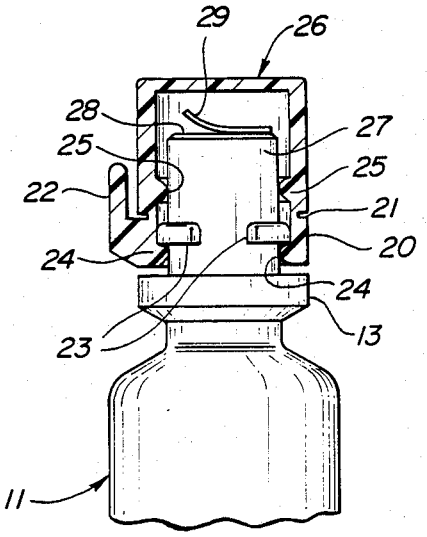

In the embodiment shown in FIG. 4, a wrench well 18 has not been provided in top of the cap 26 and the top portion of bottle 11 is formed to have a substantially uniform, cylindrical neck portion 27 instead of a tapered neck portion 12, tip 14 and tab seal 15. In this embodiment, the open top 28 of the bottle 11 can be sealed by any suitable means such as a peelably removable foil 29.

During assembly of the bottle and cap closure system of the invention (FIGS. 1 and 3), bottle 11 is stationed beneath a cap applying apparatus which places cap 19 onto bottle 11 under sufficient downward pressure until snap bead 24 engages the lower edges of outwardly protruding lugs or cams 23 with the lower end of cap 19 sitting on or closely spaced from the upper edge of shoulder 13 thereby securely locking cap 19 to bottle 11. Thus, no torque adjustment needs to be made to the cap applying apparatus to avoid screwing the cap on too tightly or too loosely. Instead, the cap applying apparatus uses a conventional piston operation whose downstroke can be readily controlled and pre-set to snap the cap onto the bottle. In addition, shoulder 13 serves to arrest the downward movement of cap 19 so that the top of the cap is prevented from contacting tab seal 15.

When the bottle contents are ready to be used, tear away band 20 can be readily removed by manually grasping pull tab 22 and cleanly tearing band 20 off of the cap 19 which is facilitated by score 20. Where the bottle is of the type shown in FIG. 3, the bottle can be opened by removing the tab seal 15 using the wrench well 18 at the top of the cap as described above. Where the bottle is of the type shown in FIG. 4, the bottle can be opened by removing the top seal; in this instance, peelably removing the foil 29.

In either embodiment, the cap 19 can be resecured to the bottle by placing the cap 19 over the top of the bottle and manually pushing down on and turning the cap 19 until inwardly protruding lugs or cams 25 engage and are secured by the lower edges of outwardly protruding lugs or cams 23 to securely lock the cap 19 to the bottle 11.

Although the bottle and cap closure system of the invention has been described with respect to bottles and caps having generally circular cross sections, it should be understood that the invention closure system is equally applicable to bottles and caps having other cross section configurations such as square, rectangular, polygonal, elliptical, oval, and the like.

What is claimed is:

1. A bottle and cap closure system comprising:

(a) a bottle body having a lower portion and an upper portion;

(b) a plurality of circumferentially spaced, outwardly protruding lugs or cams intermediate the length of said upper portion;

(c) a cap capable of being closely fitted over said upper body bottle portion;

(d) a circumferential tear away band at the lower open end of said cap having an integrally formed circumferential, inwardly protruding bead at its lower edge; and, (e) a plurality of circumferentially spaced, inwardly protruding lugs or cams intermediate the upper end of said tear away band and the top of said cap such that when said cap is placed upon said bottle, said bead engages said outwardly protruding lugs or cams on the upper portion of said bottle to secure said cap to said bottle and when said tear away band is removed from said cap, said inwardly protruding lugs or cams on said cap engage said outwardly protruding lugs or cams on the upper portion of said bottle to secure said cap to said bottle.

2. The bottle and cap closure system of claim 1 wherein said upper bottle portion is in the form of an upwardly extending tapered neck having an elongated tip extending upwardly from said tapered neck and a break off tab seal at the upper end of said elongated tip.

3. The bottle and cap closure system of claim 1 wherein said tear away band carries an outwardly protruding pull tab integrally formed therewith to facilitate removal of said tear away band from said cap and removal of said cap from said bottle.

4. The bottle and cap closure system of claim 2 wherein said cap contains a recessed wrench well in its top, said wrench well and said tab seal having substantially the same geometric configuration such that said wrench well can closely engage said tab seal to facilitate removal of said tab seal.

5. The bottle and cap closure system of claim 3 wherein a circumferential score is formed at the juncture of the upper end of said tear away band and the body of said cap.

6. A bottle and cap closure system comprising:

(a) a bottle body having a lower portion and an upper portion, said upper portion being in the form of an upwardly extending tapered neck having an elongated tip extending upwardly from said tapered neck and a break off tab seal at the upper end of said elongated tip;

(b) a plurality of circumferentially spaced, outwardly protruding lugs or cams intermediate the length of said tapered neck;

(c) a cap having a closed upper end and an open lower end;

(d) a circumferential tear away band at the open, lower end of said cap, said tear away band carrying an outwardly protruding pull tab integrally formed therewith to facilitate removal of said tear away band from said cap and an integrally formed, circumferential, inwardly protruding bead at the open, lower edge of said tear away band; and, (e) a plurality of circumferentially spaced, inwardly protruding lugs or cams intermediate the upper end of said tear away band and the top of said cap such that when said cap is placed upon said bottle, said bead engages said outwardly protruding lugs or cams on said tapered neck to secure said cap to said bottle and when said tear away band is removed from said cap, said inwardly protruding lugs or cams in said cap engage said outwardly protruding lugs or cams on said tapered neck to secure said cap to said bottle.

7. The bottle and cap closure system of claim 6 wherein said cap has a wrench well recessed in its outer closed top, said wrench well and said tab seal having substantially the same geometric configuration such that said wrench well can closely engage said tab seal to facilitate removal of said tab seal.

8. The bottle and cap closure system of claim 6 wherein a circumferential score is formed at the juncture of the upper end of said tear away band and the body of said cap to further facilitate removal of said tear away band from said cap.

* * * * *